United States Patent [19]

Rangaswamy

[11] 3,959,899

[45] June 1, 1976

[54] BOOM POINT ASSEMBLY FOR AN EXCAVATING MACHINE

[75] Inventor: Krishnaswamy Rangaswamy, Forest Park, Ill.

[73] Assignee: Page Engineering Company, Chicago, Ill.

[22] Filed: Aug. 8, 1974

[21] Appl. No.: 495,645

[52] U.S. Cl. ..... 37/116; 37/135; 254/190 R; 308/18

[51] Int. Cl.[2] ..... E02F 3/48

[58] Field of Search ..... 37/116, 135, 136; 254/190 R; 308/18

[56] References Cited

UNITED STATES PATENTS

| | | | |
|---|---|---|---|
| 1,836,281 | 12/1931 | Russell | 37/116 X |
| 2,020,073 | 11/1935 | McCullough | 254/190 R |
| 2,042,460 | 6/1936 | Fykse | 37/116 |
| 2,279,887 | 4/1942 | Hathorn | 254/190 R |
| 2,802,639 | 8/1957 | Troyer | 254/190 R UX |
| 2,947,516 | 8/1960 | Jackson | 254/190 R X |
| 3,171,633 | 3/1965 | LeBus, Jr. et al. | 254/190 R |
| 3,684,245 | 8/1972 | Maricher et al. | 254/190 R |
| 3,757,959 | 9/1973 | Thompson et al. | 254/190 R X |

FOREIGN PATENTS OR APPLICATIONS

| | | | |
|---|---|---|---|
| 257,656 | 9/1926 | United Kingdom | 37/116 |
| 154,498 | 3/1962 | U.S.S.R. | 254/190 R |

*Primary Examiner*—Clifford D. Crowder
*Attorney, Agent, or Firm*—Wegner, Stellman, McCord, Wiles & Wood

[57] ABSTRACT

A boom point assembly is provided with a sheave or sheaves that are swivel mounted to allow the sheaves and the cables supported thereby to swing sidewise relative to the centerline of the boom without applying substantial twisting forces on the boom and without causing undue wear on the sheaves or on the cables. The cross-shaft or pin for supporting the sheave or sheaves is mounted in the side cheeks of the boom point assembly with the axial thrust from the sheave bearings and mount being transverse to the cross-shaft or pin and being transmitted through a support pylon to the chords of the boom frame.

12 Claims, 11 Drawing Figures

44
7.
40
60
36
39
76
93
89
87
50
88
104
103
105
102
75
91
90
36
70
71
6.
6.
60
42
7.

95
92
70

39
36
36
108
93
90
44
107
94
84
94
107
108
42
91
75
40
60
92
95
60
110
95
81
92
70
70
71
97
83
82
85
46

76
75
77
84
88
87
89
81
83
85
92
90
93
94
92
95
94
98
100
96
97
101

136
139
175
10.
164
165
188
167
177
184
166
188
207
185
168
170
167
165
164
189
10.

BOOM POINT ASSEMBLY FOR AN EXCAVATING MACHINE

BACKGROUND OF THE INVENTION

1. Field Of The Invention

This invention relates to excavator equipment, such as draglines, shovels and the like and more particularly to a swivel mounting for a boom point sheave assembly.

2. Description Of The Prior Art

Excavating equipment, such as draglines, shovels and the like, generally are quite massive and have the capability of moving large amounts of bulk material with each cycle of operation of said equipment. Since the material is scooped up, lifted and moved at the hanging end of large diameter cables, the side-to-side swing of the cables, as said cables leave the sheaves of the boom point assembly, causes frying of the cables, wear on the flanges of the sheaves and twisting or torquing of the boom structure. After the wear of the flanges of the sheaves and/or the fraying of the cables becomes extreme, it requires shutting down the equipment and replacing and/or repairing both the cable and the sheaves which are both expensive and time consuming. In addition, twisting or torquing of the boom can lead to weakening of the boom which may result in collapse of the boom or at some point in time require repair or replacement, once again, resulting in expensive repairs and time loss.

SUMMARY OF THE INVENTION

My invention is directed to a mounting structure for the sheaves in the boom point assembly which permits the sheaves to swivel relative to a fixed cross-shaft or pin as the axial thrust is transmitted to the chords of the boom. The structure and principle of operation is such that the fraying of the cables by the flanges of the sheaves is eliminated, wear of the flanges of the sheaves is substantially reduced and twisting or torquing of the boom is minimized if not eliminated.

The boom point assembly is provided with a cross-shaft or pin carried at each end by the face plates of the assembly for supporting the weight of the sheaves. A bearing support is provided on the ends of the chords of the boom frame and is operatively connected to the cross-shaft or pin. The bearing support supports the sheave (or sheaves) for swival motion side-to-side and has a thrust bearing for receiving and transmitting to the chords of the boom the thrust loads from the sheaves. The sheaves are mounted for swivel movement relative to the cross-shaft or pin and the bearing support and may have its centerline below the centerline of the cross-shaft so as to create a self-centering effect with respect to the boom point assembly.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODMENT

Figure 1:
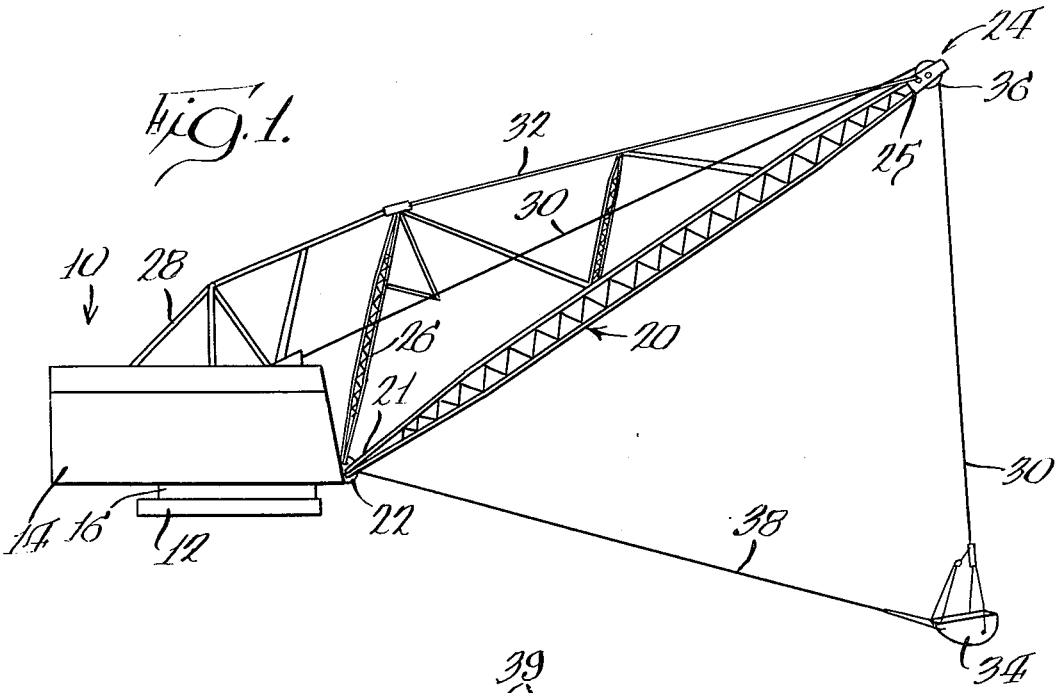
FIG. 1 is a side elevational view of an excavating machine incorporating my improved boom point assembly.
Figure 2:
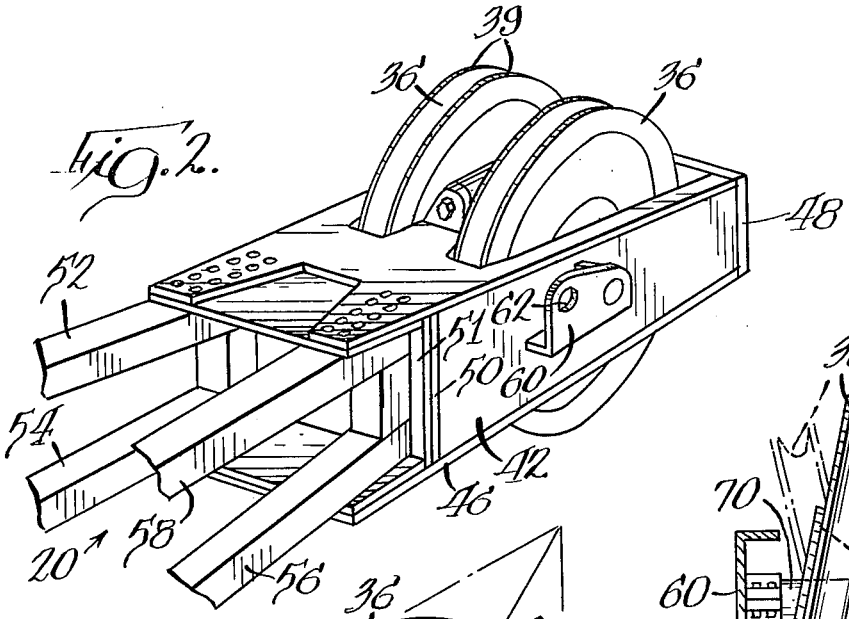
FIG. 2 is a partial enlarged perspective view of the improved boom point assembly.
Figure 3:
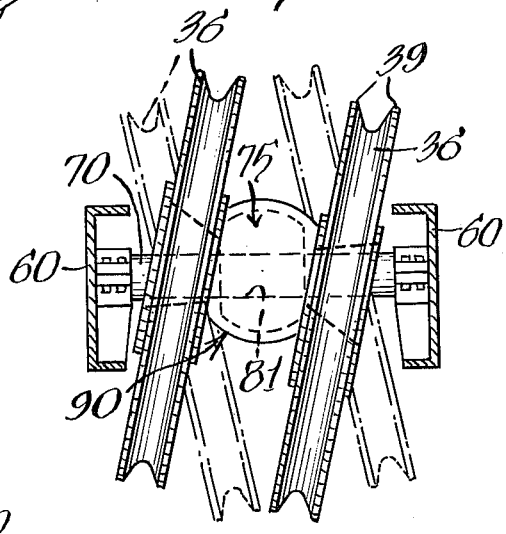
FIG. 3 is a front view partially in section of the boom point assembly showing the sheaves in two extreme positions.
Figure 4:
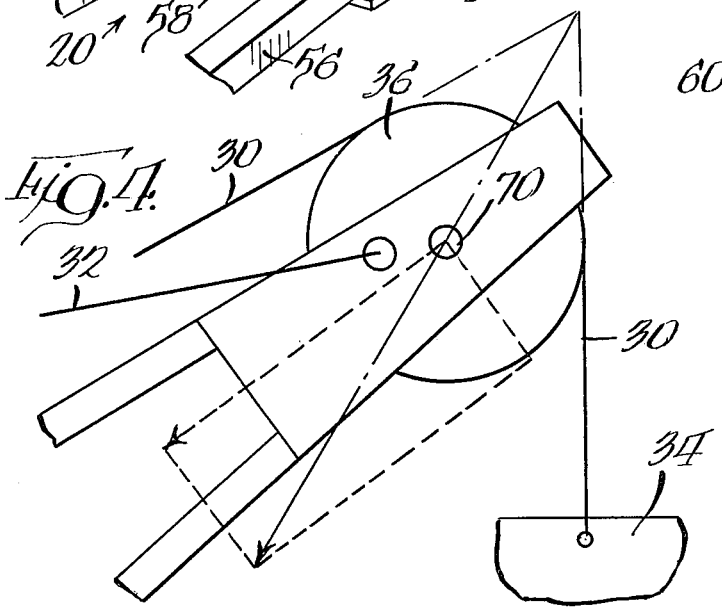
FIG. 4 is a somewhat diagramatic side view of the boom point assembly showing a force diagram superimposed thereon.

Referring to the drawings and in particular FIG. 1, an excavating machine in conventional form is illustrated and comprises a dragline excavator 10 having a base or pad 12 upon which a housing 14 is pivotally mounted by special mounting bearings 16 between the housing 14 and the pad 12. An elongate boom 20 has one end portion 21 pivoted at 22 to the front main portion of the housing 14 and has a boom point assembly 24 attached in axial alignment with the other outer end portion 25 thereof. Conventional frame 26 and gantry members 28 extend from the housing and from the boom to support the haul or lift lines 30 and the boom support lines 32. An operator is located in the housing 14 for controlling the operation of the haul line 30 which is connected to the bucket 34 around the sheaves 36 in the boom point assembly 24 and for controlling the draglines 38 connected to the bucket 34 all in a conventional fashion.

The boom point assembly 24 sustains a great deal of lateral force as the bucket 34 sways or swings from side-to-side relative to the vertical plane passing through the boom 20, the haul lines from the sheaves 36 to the housing 14 and the boom support lines 32. As the bucket 34 sways or swings from side-to-side about the boom point assembly 24, there is a tendency for the cables or lines 30 passing around the sheaves 36 to ride up on the flanges 39 on the sheaves 36 which causes fraying of the cables or lines 30 and wear on the flanges 39 of the sheaves 36. In addition, the loading caused by the side-by-side swing or sway of the bucket 34 on the sheaves 36 has a tendency to twist or torque the boom 20 which has a tendency to weaken the boom 20 over a period of time. The present invention is directed to overcoming the effect of the lateral side-by-side swinging or swaying of the bucket 34 in fraying the cables or lines 30, wearing the flanges 39 of the sheaves 36 and twisting or torquing of the boom 20.

Figure 5:
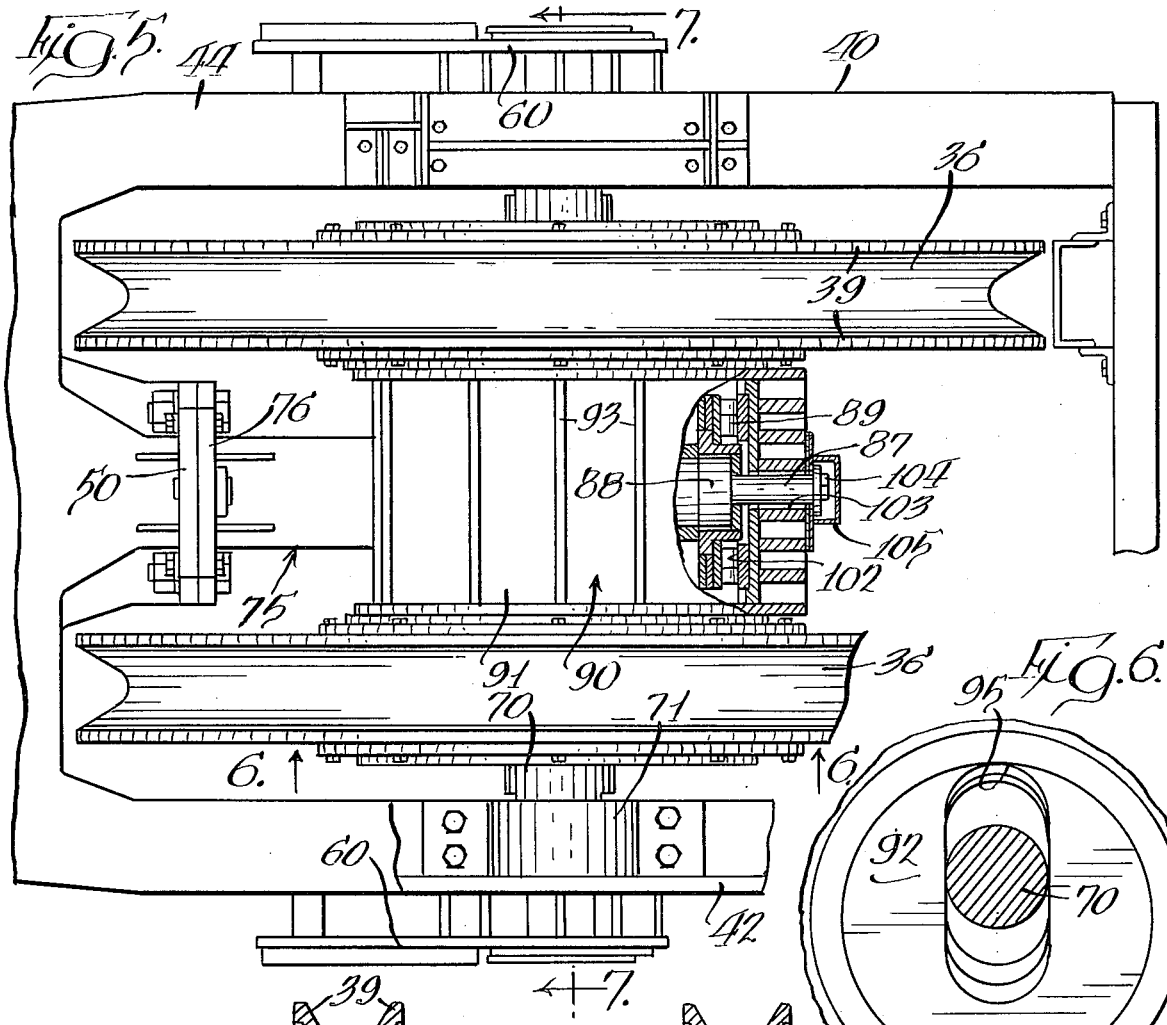
FIG. 5 is an enlarged top view of the boom point assembly of FIG. 2 with some parts broken away and in section.
Figure 6:
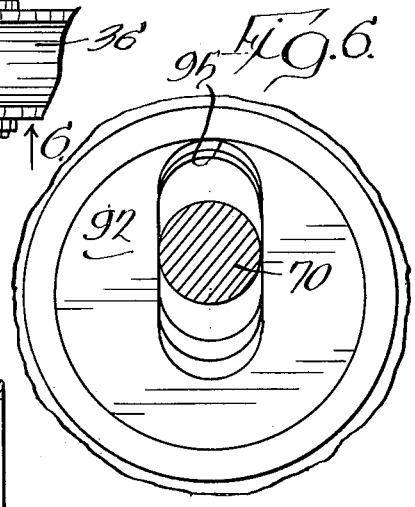
FIG. 6 is a cross-sectional view taken along the lines 6—6 of FIG. 5.
Figure 7:
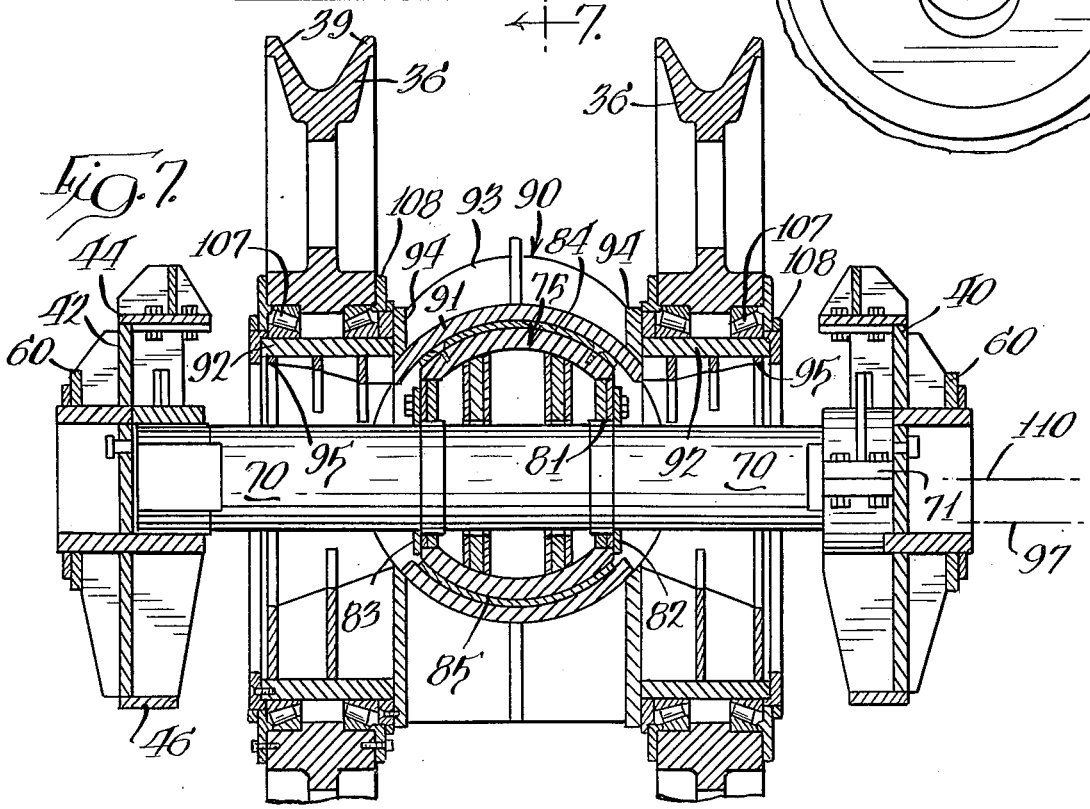
FIG. 7 is a cross-sectional view taken along the lines 7—7 of FIG. 5.

Referring to the form of invention shown in FIGS. 2 through 8, the boom point assembly 24 is illustrated as comprising a pair of side plates 40 and 42 which are connected to cutout top and bottom plates 44 and 46, to front plate 48 and to rear plate 50. The rear plate 50 is connected to the outer end plate 51 of the boom 20 with extensions of the top plate 44 and bottom plate 46 overlapping the main chords 52, 54, 56 and 58 of the boom 20 and being riveted or bolted thereto from both the top and the bottom. Secured to the respective side plates 40 and 42 are the mounting brackets 60 which have openings 62 to which the boom support lines 32 from the housing 14 are connected. A cross-shaft or pin 70 extends from between the side plates 40 and 42 and brackets 60 and is fixed relative thereto against rotation by means of welding, bolting, keying or the like. As shown in FIGS. 5 and 7, retainers 71 are bolted to parts of the side plates over the ends of the cross-shaft or pin 70 to secure said pin 70 to the side plates.

A bearing support 75 has a mounting plate 76 rigidly bolted to plate 50 of the boom point assembly 24 and to the end plate 51 of the boom 20 and has a bearing portion 77 projecting outwardly from said plate 76. Said portion 77 encircles said pin 70 at the midportion thereof with said pin 70 passing through the transverse opening 81 in said portion 77. The bearing portion 77 of the bearing support 75 has parallel, spaced apart side portions 82,83 and arcuately curved top and bottom portions 84,85 which portions 84,85, as shown, are segments of a cylinder with the axis of the cylinder extending transverse to the axis of the opening 81 and pin 70 and with said axis lying slightly above the axis of the opening 81 and pin 70. The outer end 86 of the bearing support 75 has a post 87 and a collar 88 around which is rotatably supported a thrust bearing 89 which is adapted to rotate relative to the axis of the post 87.

Figure 8:
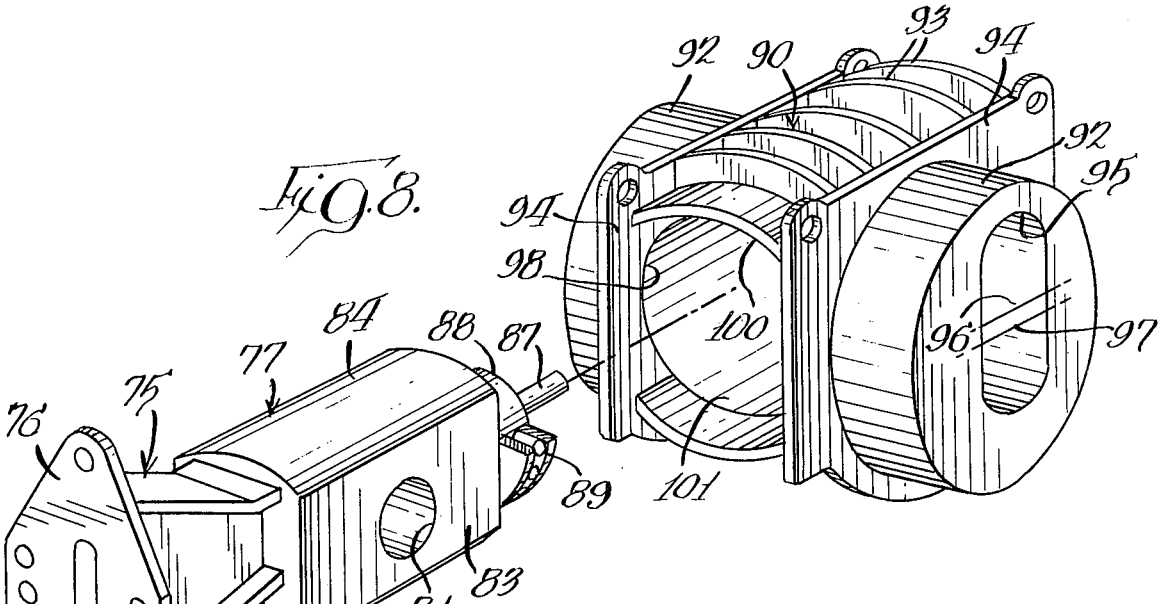
FIG. 8 is an exploded perspective view of the bearing support and sheave bearing of the assembly.

A sheave saddle 90, as is best shown in FIGS. 7 and 8, comprises a body portion 91 having a pair of sidewardly extending circular projections, lugs or hubs 92. The body portion 91 has reinforcing ribs 93 extending between mounting flanges 94 which flanges 94 act as shoulders for the lugs 92. The lugs 92 on the saddle member 90 have vertically oriented oblong slots or openings 95 extending inwardly from the outer faces thereof and, as seen in FIG. 7, the vertical height of said slots 95 is reduced as the center of body portion 91 is approached from each side. The geometric center 96 of the oblong slots 95 is above the geometric center 97 of the projections, lugs or hubs 92. Formed in the body portion 91 of the saddle 90 is a blind opening 98 which has arcuately curved upper and lower surfaces 100,101, which surfaces are segments of a cylinder which has a center at the geometric center of the opening 98. The opening 98 in the saddle 90 is adapted to receive the bearing portion 77 of the bearing support 75 with the upper curved surface 100 bearing upon the curved top bearing portion 84 of the bearing support 75 with the lower curved surface 101 engaging the bottom curved portion 85 of said bearing support 75. The cross-shaft or pin 70 passes through the vertically oriented openings 95 in the projections or lugs 92 of the saddle 90 so that the saddle 90 can rotate or oscillate from side-to-side a certain number of degrees about the axis of the opening 98 as the top and bottom of the vertically oriented oblong openings or slots 95 move up and down relative to the cross-shaft or pin 70. The far wall 102 of the blind opening 98 of the body portion 91 has a reduced diameter opening 103 through which the post 87 on the bearing support 75 projects with the thrust bearing 89 acting between the end of the bearing portion 77 of the bearing support 75 and the wall 102 of the saddle 90. The rotation or oscillation of the saddle 90 on the bearing support 75 is about the axes of the post 87 and bearing 89. Appropriate fastening means such as a nut 104 may be used to secure the saddle 90 to the bearing support 75. A shield 105 is provided over the nut to protect the parts against the weather.

The sheaves 36 are rotatably mounted by means of bearings 107 on the projections or lugs 92 on the saddle 90 with appropriate mounting rings 108 being used to hold the sheaves for rotation on the projections 92. The cross-shaft or pin 70 will pass through the projections or lugs 92 and sheaves 36 and has the axis 110 of said pin 70 above the axis of the sheaves 36. In this way, since the moment of inertia of the sheaves 36 is below the axis of the pin 70, the sheaves 36 will have a tendency to always be positioned, properly oriented with respect to the saddle 90 and the cross-shaft or pin 70. As can be seen in FIG. 7, the openings through the projections or lugs 92 of the saddle 90 taper outwardly from the center thereof, the saddle 90 with the respective sheaves can rotate or oscillate from side-to-side about the axis of the bearing support 75 without contacting the cross-shaft or pin 70.

With the boom point assembly 24 positioned on the outer end of the boom 20, the boom support lines 32 will engage with the openings 62 in the mounting brackets 60 on the opposite sides 40 and 42 of the assembly so as to support the outer end 25 of the boom relative to the housing 14. The axis of the boom support lines 32 will pass substantially through the center of the cross-shaft or pin 70 for supporting the outer end of the boom and for supporting the weight of the saddle and sheave assembly. The haul lines 30 from the housing 14 will pass around the outer periphery of the sheaves 36 and will be connected to the bucket 34. In the static condition, the cross-shaft or pin 70 will support only the downward weight of the bucket, haul lines, sheaves and saddle. The resultant forces will urge the saddle 90 in the direction of the axis of the boom so that the majority of the load on the sheaves 36 will be transmitted through the thrust bearing 89 and the bearing support 75 to the end plate 51 of the boom 20 and, accordingly, through the four major chords 52, 54, 56, 58 of the boom structure.

During use, as the bucket 34 is hoisted from the ground and the boom 20 is sidewardly moved about the vertical axis of the pads 12, the bucket 34 will have a tendency to follow or lag behind the boom point assembly 24 causing the lines or cables 30 from the bucket to approach the sheaves 36 at an angle. The tilting or canting effect caused by the lagging of the bucket behind the boom will rotate or cant the sheaves 36 and saddle 90 about the thrust bearing 89 on the bearing support 75 so that the line or cable 30 will approach and pass between the flanges 39 of the sheaves 36 in a straight line. When the sideward sweep of the boom is halted, the bucket 34 will catch up and will pass the vertical plane of the boom taking the sheaves 36 and saddle 90 with it so that the line or cable 30 will continue to approach the flanges of the sheaves 36 in alignment with the axis of the cable. In other words, the saddle 90 and associated sheaves 36 will rotate or cant from side-to-side about the axis of the bearing support 75, post 87 and the thrust bearing 89 of the bearing support so that the lines or cables 30 will approach the groove between the flanges 39 in the outer surface of the sheaves 36 in alignment with the axis of the cables. The loading of the sheaves and saddle will be such as to transmit the forces through the thrust bearing 89 and bearing support 75 to the end plate 51 on the boom which will be a straight axial force and not a twisting or torquing force. Accordingly, the boom will not be twisted or torqued as was true heretofore. Since the axis of the sheaves 36 is below the axis of the cross-shaft or pin 70, the sheaves 36 and their associated saddle 90 will have a self-centering effect tending to reduce wear on the bearings.

Figure 9:
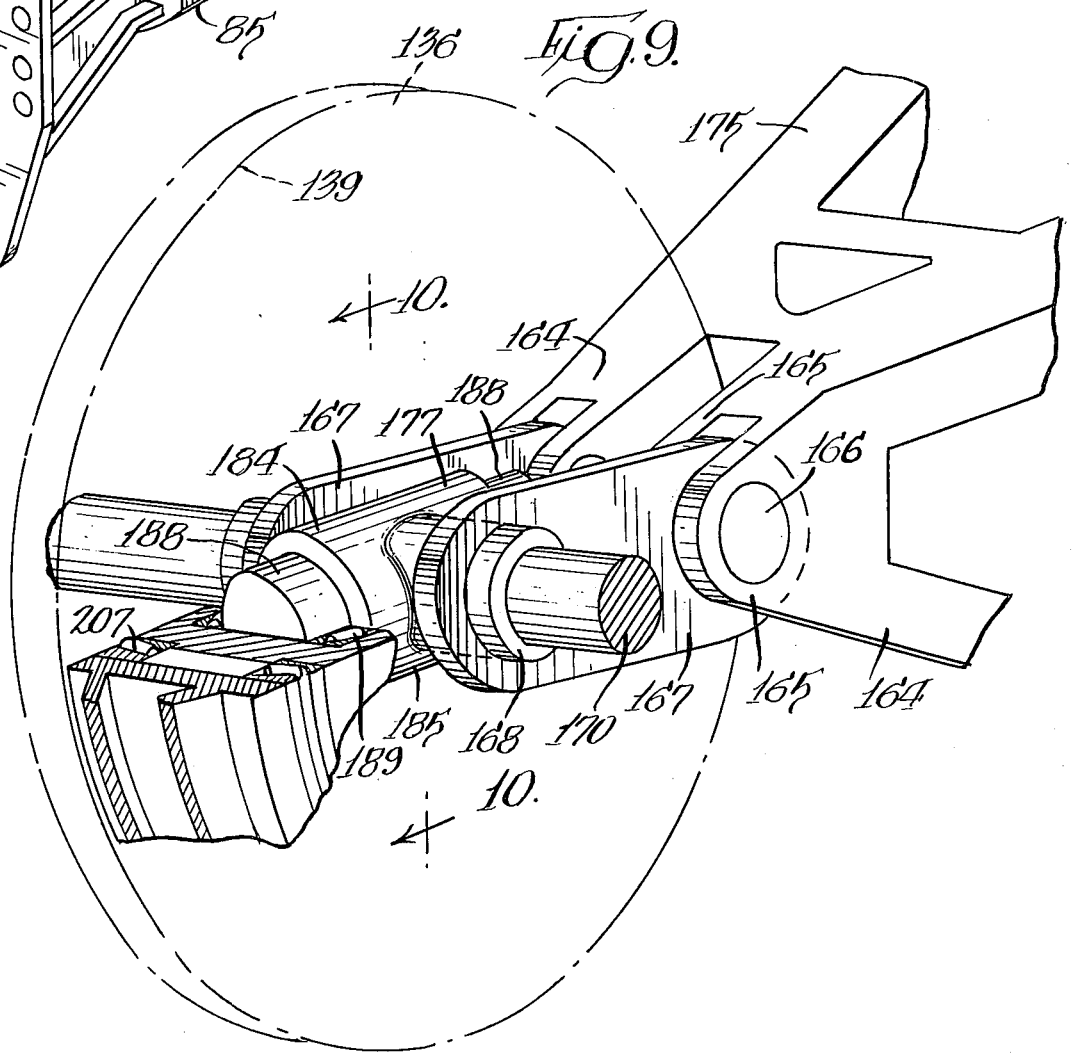
FIG. 9 is a perspective view of a modified form of my invention showing a single sheave mounting.
Figure 10:
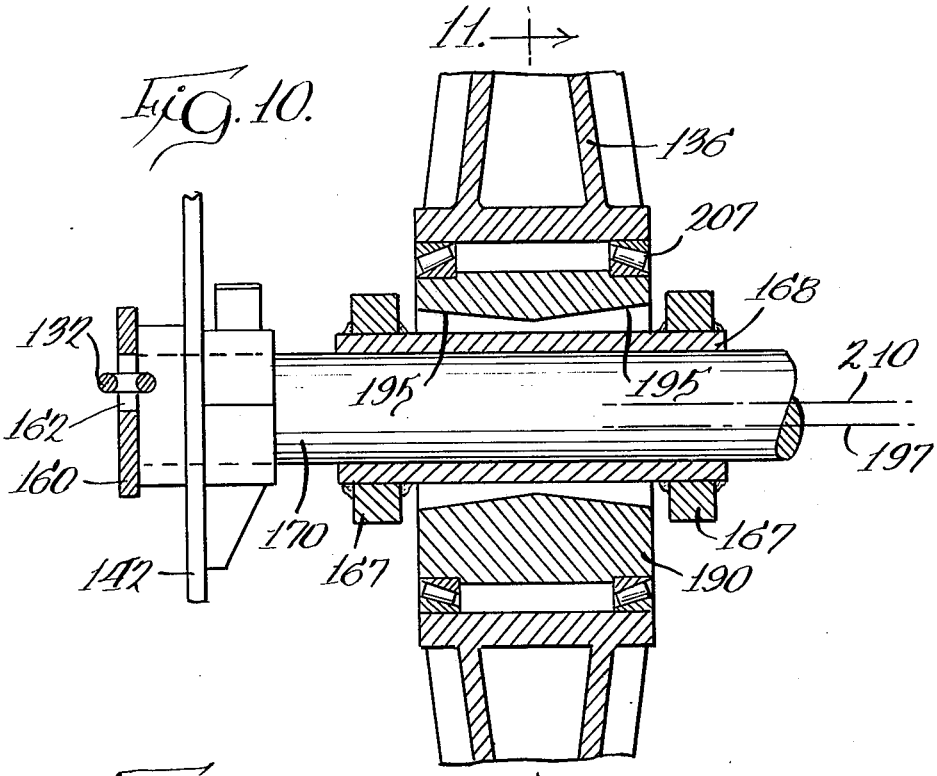
FIG. 10 is a broken away cross-sectional view taken along the line 10—10 of FIG. 9; and, FIG. 11 is a cross-sectional view taken along the lines 11—11 of FIG. 10.
Figure 11:
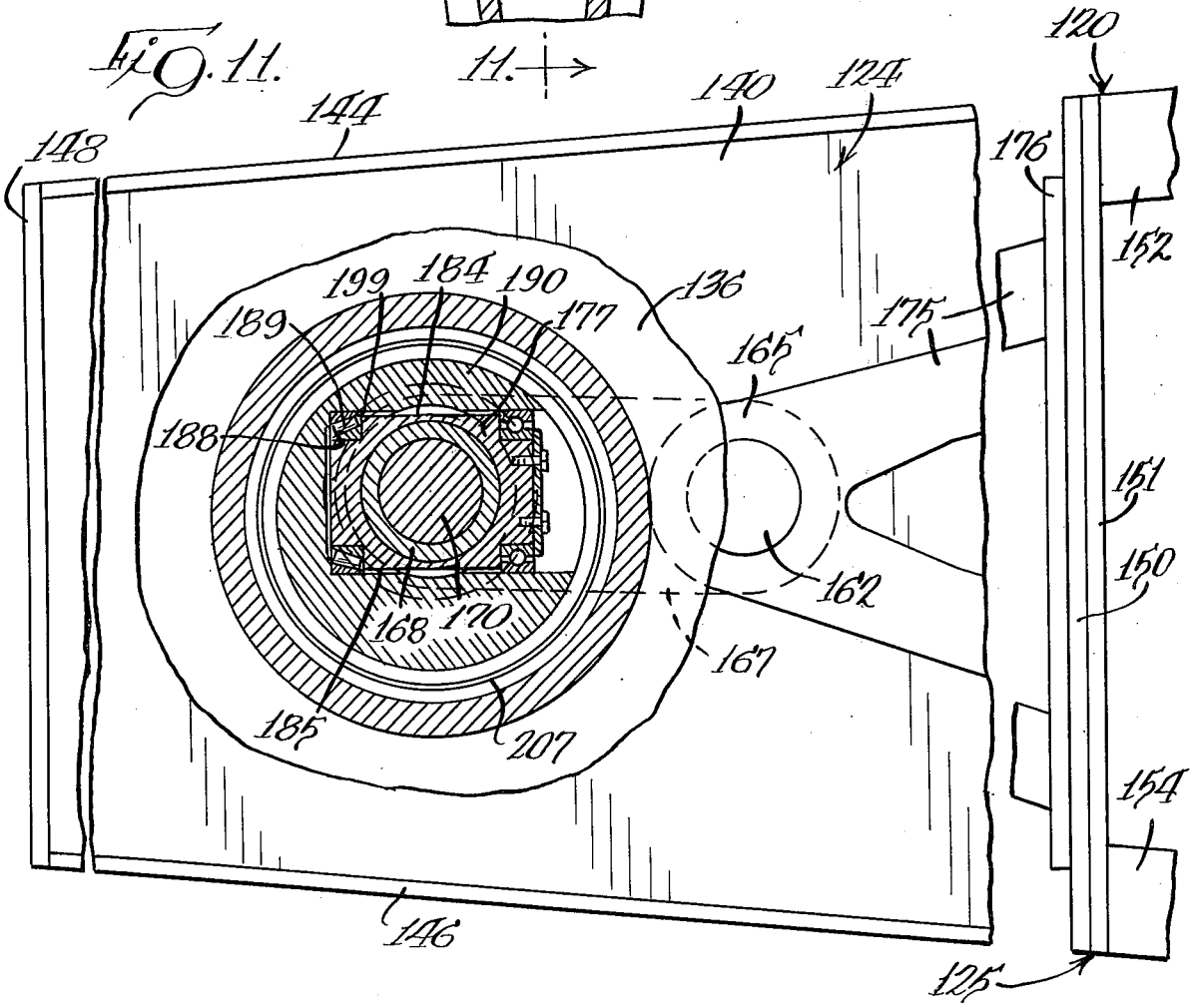

In a modified form of my invention, as shown in FIGS. 9 through 11, a single sheave 136 is mounted in a boom point assembly 124 to swivel or oscillate in such a way as to reduce wear on the flanges 139 of the sheave 136 and to reduce or eliminate twisting or torquing of a boom 120.

The outer end portion 125 of the boom 120 has an end plate 151 connected on the ends of the main chords 152,154,156,158. The boom point assembly 124 has side plates 140,142, front plate 148, rear plate 150 and top and bottom plates 144,146, respectively. A bracket 160 is mounted on each side plate 140,142 to which bracket the support lines 132 are mounted by passing through openings 162 therein. A cross-shaft or pin 170 extends between the brackets 160 and the side plates 140,142 and is fixed thereto against rotation about the axis 210 of said pin 170.

A bearing support 175, having a mounting plate 176 bolted to both the rear plate 150 of the boom point assembly 124 and to the end plate 151 of the boom 120, has a pair of spaced apart trunnions 164 projecting forward therefrom. Each trunnion 164 has a pair of legs 165 between which is pinned one end portion of a link 167 by means of pin 166. The other end portions of the two links 167 are secured to the end portions of a sleeve 168 fitted over the central portion of the cross-shaft or pin 170. A bearing portion 177 of the bearing support 175 is fixed to the midportion of the sleeve 168 and pin 170 and has an axis running transverse to the axis of the cross-shaft or pin 170 and has an arcuately curved top and bottom portion 184,185. As shown, the arcuate top and bottom surfaces are circular and have an axis coinciding with the axis of the bearing portion 177. The front and rear ends of the bearing portion 177 have reduced diameter collars 188 upon which is seated one raceway of a pair of bearings 189.

A combined hub and saddle 190 encircles said bearing portion 177 of the pylon 175 and has raceways 199 engaging said bearings 189. As seen in FIG. 10, the saddle 190 has a pair of transverse inwardly tapered openings or oblong slots 195 with the long axis of the oblong extending generally vertically so that the hub or saddle 190 may pivot or rotate from side-to-side relative to the cross-shaft or pin 170 about an axis extending transverse to the axis 197 of said hub or saddle 190. The oblong slots 195 are formed through said hub or saddle 190 above the geometric center of said hub or saddle 190 so that as said hub or saddle 190 pivots or rotates on the bearings 189, it will have a self-centering effect caused by the moment of inertia about the axis 197 of said saddle 190 being below the center line or axis 210 of the pin 170. The sheave 136 rotates relative to the hub or saddle 190 on the bearings 207 and since the axis of the hub or saddle 190 is the same as the axis of the sheave 136, the sheave 136 will also self-center.

The description of FIGS. 9 through 11 makes it possible to mount a single sheave 136 such that all of the weight of the sheave on the haul line is carried by the pin and side plates 140,142 of the boom point assembly with the thrust loads from the sheave being transmitted through the saddle and links of the bearing support to the bearing support and to the boom. As the bucket sways from side-to-side relative to the vertical plane of the boom, the sheave will pivot or rotate about the axis transverse to the axis of the sheave so as to reduce wear on the flanges 139 of the sheave 136 and to reduce twisting or torquing of the boom.

I claim:

1. A dragline excavating machine having a housing and a boom pivotally mounted at one end portion to said housing, a boom point assembly mounted on the other end portion of said boom and having a pair of side plates, a cross-shaft traversing the space between said pair of side plates, the end portions of said shaft being fixed in said plates, boom support lines running from said housing to said plates of said assembly, a bearing support connected to the end of the boom and to the cross-shaft and having bearing means thereon, said bearing support having an axis extending outwardly from the end of said boom, a saddle mounted on said bearing means for rotating movement about said axis of said bearing support, said saddle having a hub with an opening through which said cross-shaft extends, said opening in the hub being elongate in a vertical plane with the long axis of the opening extending vertically relative to the axis of the cross-shaft, a sheave rotatably mounted on said hub and saddle, a thrust bearing between said bearing support and said saddle for transmitting thrust loads from said saddle to said bearing support and to said boom, and a haul line running from the housing around the sheave and being connected to a bucket whereby side-to-side swing of the bucket cants the sheave, hub and saddle from side-to-side about the axis of the bearing support with said saddle rotating on said bearing means for keeping flanges on the sheave substantially in alignment with the haul line from the bucket.

2. In a dragline excavating machine as claimed in claim 1 wherein said saddle has an opening with a curved bearing surface which engages with and rotates relative to a curved bearing surface forming part of said bearing means on said bearing support as said sheave, hub and saddle are canted from side-to-side.

3. In a dragline excavating machine as claimed in claim 1 wherein said saddle has a pair of hubs extending on opposite sides thereof for supporting in rotating relation thereto a pair of sheaves.

4. In a dragline excavating machine as claimed in claim 1 wherein said hub and saddle are combined and have the sheave encircling said hub and saddle and wherein said bearing support has a pair of links connected to said cross-shaft on opposite sides of said saddle.

5. In a dragline excavating machine as claimed in claim 1 wherein the axis of said cross-shaft is located above the axis of said hub and sheave so that said sheave will be self-centering.

6. In a dragline excavating machine as claimed in claim 1 wherein said boom has at least four main chords extending throughout the length thereof, and wherein said bearing support has a mounting plate lying in a plane parallel to the axis of the cross-pin and which mounting plate receives the radial thrust of said sheave and transmits said thrust evenly to each main chord of the boom.

7. In a dragline excavating machine as claimed in claim 6 wherein said saddle has an opening for receiving a portion of said bearing support, said bearing means on said bearing support includes a curved surface, one wall of said opening in the saddle having a mating curved surface engaging with the curved surface of the bearing means and being free to rotate relative thereto.

8. An excavating machine having a housing movably mounted on a ground anchoring pad, a boom having at least three main chords and being pivotally connected at one end to said housing, a boom point assembly fixed in axial alignment with said boom at the other end thereof and having a pair of side plates, a cross-shaft traversing the space between said side plates and having end portions of the cross-shaft fixed to said side plates, an end plate carried by the ends of the chords of said boom, boom support lines extending from said housing to said side plates of said assembly, a bearing support connected to said end plate and to the center portion of said cross-shaft and having a bearing surface and a thrust bearing thereon, at least one sheave carried by said bearing support and having a mounting means connected to the midportion of said sheave, said mounting means encircling a portion of the bearing support and applying weight to said bearing surface and applying thrust to said thrust bearing thereon, said mounting means having oblong side openings through which said cross-shaft passes with the major axis of the oblong lying generally vertical, and a haul line running from the housing around the sheave and being connected to a bucket whereby side-to-side swing of the bucket cants the sheave from side-to-side with the mounting means of the sheave riding on the bearing surface for permitting the flanges of the sheave to substantially align with the haul line as said oblong openings permit said mounting means to rotate relative to said cross-shaft.

9. An excavating machine as claimed in claim 8 wherein said mounting means is a saddle having at least one hub upon which said sheave is rotatably mounted.

10. An excavating machine as claimed in claim 9 wherein said saddle has a blind opening therein into which said bearing surface and said thrust bearing extend with the bearing surface engaging a mating bearing surface in one wall of said opening and wherein said thrust bearing engages an end of said blind opening for receiving thrust from said saddle and transmitting said thrust to the boom.

11. An excavating machine as claimed in claim 8 wherein said mounting means is a saddle having a pair of sidewardly projecting hubs upon each one of which is rotatably mounted a sheave.

12. A boom point assembly for an excavating machine having a boom with a pair of spaced apart side plates connected at the outer end portion thereof, a cross-shaft traversing the space between said pair of side plates, a bearing support connected to the outer end of said boom and to the center portion of said cross-shaft, said bearing support having a curved bearing surface and a thrust bearing surface at right angles to each other, a saddle movably mounted on said curved bearing surface and applying thrust to said thrust bearing surface, at least one sheave rotatably mounted on said saddle, said saddle having enlarged openings through which said cross-shaft passes, and a haul line passing around the sheave and being connected to a bucket whereby side-to-side swing of the bucket moves the sheave and saddle from side-to-side relative to the cross-shaft for keeping the flanges of the sheave substantially in alignment with the haul line to the bucket and thrust loads on the sheave from the haul line are transmitted through the thrust bearing and the bearing support to the boom.

* * * * *